United States Patent [19]

Panaro et al.

[11] 4,320,376

[45] Mar. 16, 1982

[54] STRESS RELIEVING WELD JOINT FOR COMPOSITE FUSIBLE ELEMENT

[76] Inventors: Robert J. Panaro, 12 Coleman Rd., Byfield, Mass. 01922; Richard W. Robbins, 10 Columbus Ave., Newburyport; Charles F. Smith, Northern Blvd., Plum Island Newbury, both of Mass. 01950

[21] Appl. No.: 169,329

[22] Filed: Jul. 16, 1980

[51] Int. Cl.[3] ..... H01H 85/16

[52] U.S. Cl. ..... 337/252; 337/291

[58] Field of Search ..... 337/158, 159, 160, 251, 337/252, 290, 291

[56] References Cited

U.S. PATENT DOCUMENTS

| | | | |
|---|---|---|---|
| 3,394,333 | 7/1968 | Jacobs | 337/291 X |
| 4,010,438 | 3/1977 | Scherer | 337/291 X |
| 4,228,417 | 10/1980 | Belcher | 337/252 |

*Primary Examiner*—George Harris

*Attorney, Agent, or Firm*—Erwin Salzer

[57] ABSTRACT

A welded composite fusible element utilizing weld joints, or welded hinges, to interconnect the component parts of it. The above referred-to weld joints or hinges interconnect portions of a fusible element which are fragile and easily damaged with portions of the fusible element which are rugged and which involve little or no danger of damage in the process of assembly. The function of stress relieving hinges or weld joints according to this invention is to protect the delicate component of the composite fusible element.

4 Claims, 7 Drawing Figures

STRESS RELIEVING WELD JOINT FOR COMPOSITE FUSIBLE ELEMENT

BACKGROUND OF THE INVENTION

Until recently, fusible elements were generally stamped or otherwise formed from a single piece of sheet metal. Recent escalation in the price of precious metals, notably silver, has caused there to be a reduction in the use of such metals for fusible elements.

In order to retain the performance heretofore provided by one piece silver elements, composite fusible elements have evolved using copper and other less precious metals which closely parallel the performance heretofore derived from silver.

Composite fusible elements generally have relatively rigid tab components interconnected by a relatively fragile fusible component by means of a weld. In order to protect the fragile fusible component in such composites, the weld joint between components has been designed to additionally function as a hinge to absorb stresses which might ordinarily damage the fragile fusible component.

SUMMARY OF THE INVENTION

A composite fusible element for use in electric fuses having two axially outer relatively strong tabs which are lapped with, and conductively interconnected by, welds with a relatively fragile fusible element.

The welds located in the lapped region, are linear and arranged transverse to the axes of said fusible elements and said tabs and provide linear hinges between said tabs and said fusible elements which allow relative movements between these two parts.

DESCRIPTION OF PREFERRED EMBODIMENT

Figure 1:
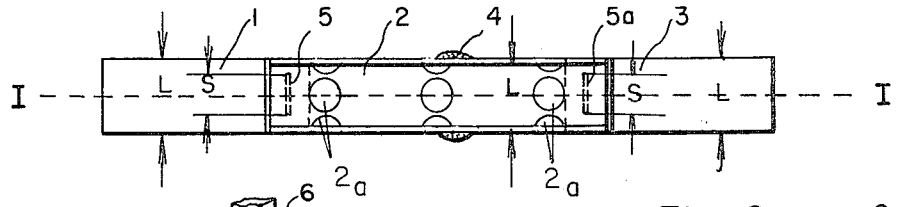
FIG. 1 is a top plan view of a welded composite fusible element.

Referring now to the drawings, FIG. 1 is a plan view of a fusible element according to the present invention. Numeral 1 has been applied to indicate a first tab conductively welded at weld joint 5 to one end of a fusible element 2. Fusing element 2 has serially arranged perforations 2*a* establishing regions of reduced cross-sectional area. An overlay 4 of a metal having a melting point less than the melting point of the metal of which fusible element 2 is made is located in proximity to a selected point of reduced cross-section 2*a*. The other end of fusible element 2 is welded at 5*a* to a second tab 3.

Figure 2A:
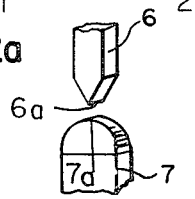
FIG. 2*a* is an isometric view of the welding electrodes.

FIG. 2*a* illustrates a pair of electrodes suitable for welding composite fusible elements of this type. Numerals 6,6*a* have been applied to indicate the shaft and contact surface, respectively, of a first electrode. Numerals 7,7*a* have been applied to indicate the shaft and contact surface, respectively, of a second electrode. The configuration of contact surfaces 6*a*,7*a* permits the resistance welding of highly thermally conductive sheet metals of the type used for fusible elements. The relatively narrow, linear contact surface 6*a* establishes a region of high current density along its linear surface for rapid heating said surface. The opposing contact surface 7*a* is relatively large and of elongated convex configuration. Such a configuration reduces thermal losses to a predetermined extent, while maintaining a sufficient contacting area for effective welding, and more particularly flexible welding joints as more fully described below.

Figure 2C:
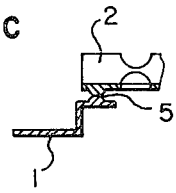
FIG. 2*c* is a section through the weld on an enlarged scale.
Figure 2B:
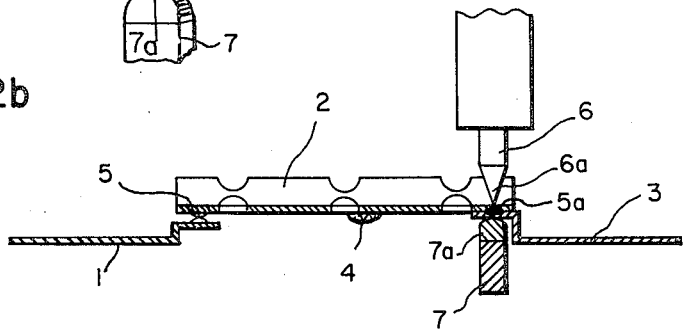
FIG. 2*b* is a side view of a longitudinal section taken along line I—I of FIG. 1, illustrating the electrodes in welding position.

FIG. 2*b* is a side view of a longitudinal section taken along line I—I of FIG. 1 showing proper orientation of said electrodes relative to the composite fusible element. Electrode contact surfaces 6*a* and 7*a* are disposed transverse to the longitudinal axis of parts 1,2 and 3. Tab 1 has been welded to one end of fusible element 2 at weld joint 5. The opposite end of fusible element 2 is in the process of being welded to tab 3 at weld joint 5*a*. It can be seen at joint 5*a* that fusible element 2 is lapped with tab 3 prior to welding and are flush along their lapped surfaces. Once pressure and current are applied to electrodes 6,7, the lapped surfaces become separated by projections induced by said electrodes as shown in FIGS. 3*a*–3*c*.

FIG. 2*c* shows the weld 5 between fusible element 1, and tab 2 on a larger scale. Weld joint 5 comprises a projection from tab 1 and a projection from fusible element 2. Under heat and pressure the component metals in contact with electrodes 6,7 soften and flow together forming the weld 5. The weld 5 thus established, separates the lapped surfaces by said projections and permits said components 2,3 to hinge by way of projection 5 relative to one another in response to forces perpendicular to the longitudinal axis of parts 2 and 3.

Figure 3A:
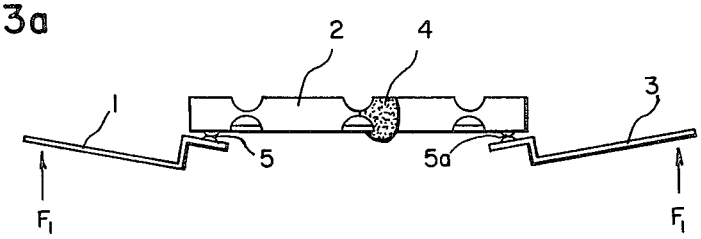
FIGS. 3*a*, 3*b*, 3*c* are side views of a welded composite fusible element illustrating the hinge action of the weld.
Figure 3B:
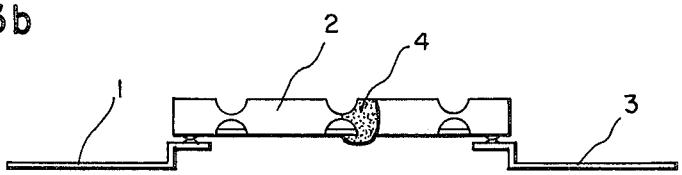
Figure 3C:
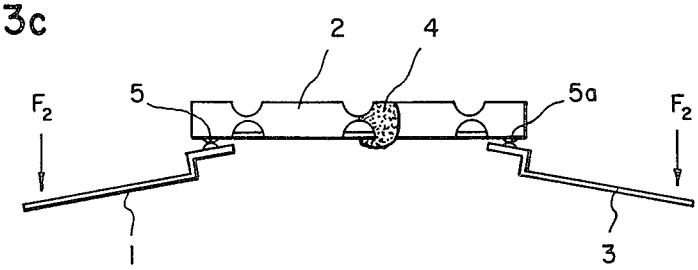

FIGS. 3*a* and 3*c* illustrate the hinge action of tabs 1,3 relative to fusible element 2.

In FIG. 3*a* an upward force F1 at right angles to the longitudinal axis of tabs 1,3 is transmitted by welds 5,5*a* to fusible element 2 which is fragile on account of its many perforations. FIG. 3*b* illustrates the fusible element 2 in its normal position, i.e. under no stress. In FIG. 3*c*, a force F2 again essentially at right angles to the longitudinal axis of parts 1,2,3, but in downward direction, results in a hinging movement of parts 1 and 3 relative to fragile part 2. The overall effect of said tabs 1 and 3 hinging in response to perpendicularly applied forces is to prevent said forces from overstressing, and possibly damaging, the fragile fusible element 2.

It will be observed from FIG. 1 that fusible element 1 is channel-shaped having the width L and that tabs 1 and 3 are plate-shaped having also the width L. The welds 5 and 5*a* have, however, but the smaller width S. This difference in width L and S greatly contributes to the flexibility of welds 5 and 5*a*.

We claim as our invention:

1. A composite fusible element for use in electric fuses comprising:

(a) axially outer relatively rigid tabs;

(b) an axially inner relatively fragile perforated fusible element;

(c) said axially outer tabs are lapped in relation to said fusible element;

(d) welds conductively interconnecting said tabs and said fusible element in the area of said lapped relation;

(e) said welds are essentially linear and disposed transverse to the longitudinal axis of said fusible element and form fusible hinges projecting beyond the planes defined by said fusible element and said tabs and allowing relative movement between said fusible element and said tabs.

2. A fusible element as specified in claim 1 wherein the length of said welds is shorter than the width of said fusible element and the width of said tabs.

3. A composite fusible element for use in electric fuses comprising (a) a relatively fragile fusible element having a plurality of points of reduced cross-section;

(b) relatively strong tabs lapped over said fusible element and welded to said fusible element;

(c) the regions where said fusible element and said tabs are welded to each other being disposed transversely to the longitudinal axes of said fusible element and said tabs; and (d) the metal of which said fusible element is made and the metal of which said tabs are made projecting beyond the plane defined by said fusible element and beyond the plane defined by said tabs and forming projections spaced from said first mentioned plane and spaced from said second mentioned plane.

4. A composite fusible element as specified in claim 3 wherein said fusible element has a predetermined width and said tabs have a predetermined width and the region where said tabs are welded to said fusible element is shorter than the width of said fusible element and shorter than the width of said tabs.

* * * * *